US008606440B2

(12) United States Patent
Solheim

(10) Patent No.: US 8,606,440 B2
(45) Date of Patent: Dec. 10, 2013

(54) METHOD FOR DETERMINING CORRECTION UNDER STEERING OF A POINT ON A TOWED OBJECT TOWARDS A GOAL POSITION

(75) Inventor: Peder Solheim, Sandnes (NO)

(73) Assignee: Geograf AS, Sandnes (NO)

( * ) Notice: Subject to any disclaimer, the term of this patent is extended or adjusted under 35 U.S.C. 154(b) by 0 days.

(21) Appl. No.: 13/501,706

(22) PCT Filed: Oct. 15, 2010

(86) PCT No.: PCT/NO2010/000364
§ 371 (c)(1),
(2), (4) Date: May 9, 2012

(87) PCT Pub. No.: WO2011/049457
PCT Pub. Date: Apr. 28, 2011

(65) Prior Publication Data

US 2012/0239232 A1 Sep. 20, 2012

(30) Foreign Application Priority Data

Oct. 20, 2009 (NO) ..... 20093176

(51) Int. Cl.
*B63C 13/00* (2006.01)

(52) U.S. Cl.
USPC ..... 701/21; 367/19

(58) Field of Classification Search
USPC ..... 701/21; 367/19
See application file for complete search history.

(56) References Cited

U.S. PATENT DOCUMENTS

2002/0161491 A1* 10/2002 Crane et al. ..... 701/21
2006/0260529 A1* 11/2006 Hillesund et al. ..... 114/344

FOREIGN PATENT DOCUMENTS

GB 2364388 1/2002
NO 20063819 2/2007

OTHER PUBLICATIONS

James Carvill, "Mechanical Engineer's Data Handbook", 2009, Elsevier, Reprint 2009, p. 58.*

* cited by examiner

*Primary Examiner* — Mary Cheung
*Assistant Examiner* — Yuen Wong
(74) *Attorney, Agent, or Firm* — Gablegotwals

(57) ABSTRACT

A method for determining correction during steering of a point on an object towed by a towing device, the object point, toward a target position, the object being provided with a bird, including the steps of determining a target position; determining the position of the object point, determining the speed and acceleration of the object point and directions of these and thereby determining an inline direction; determining whether the inline is directed toward the target position and if it deviates from the desired direction, determining a distance vector between the object point and the target position; calculating the object point distance, speed and acceleration components at least in the lateral direction or the vertical direction; and transferring values for the components to a control system for the corresponding bird.

2 Claims, 1 Drawing Sheet

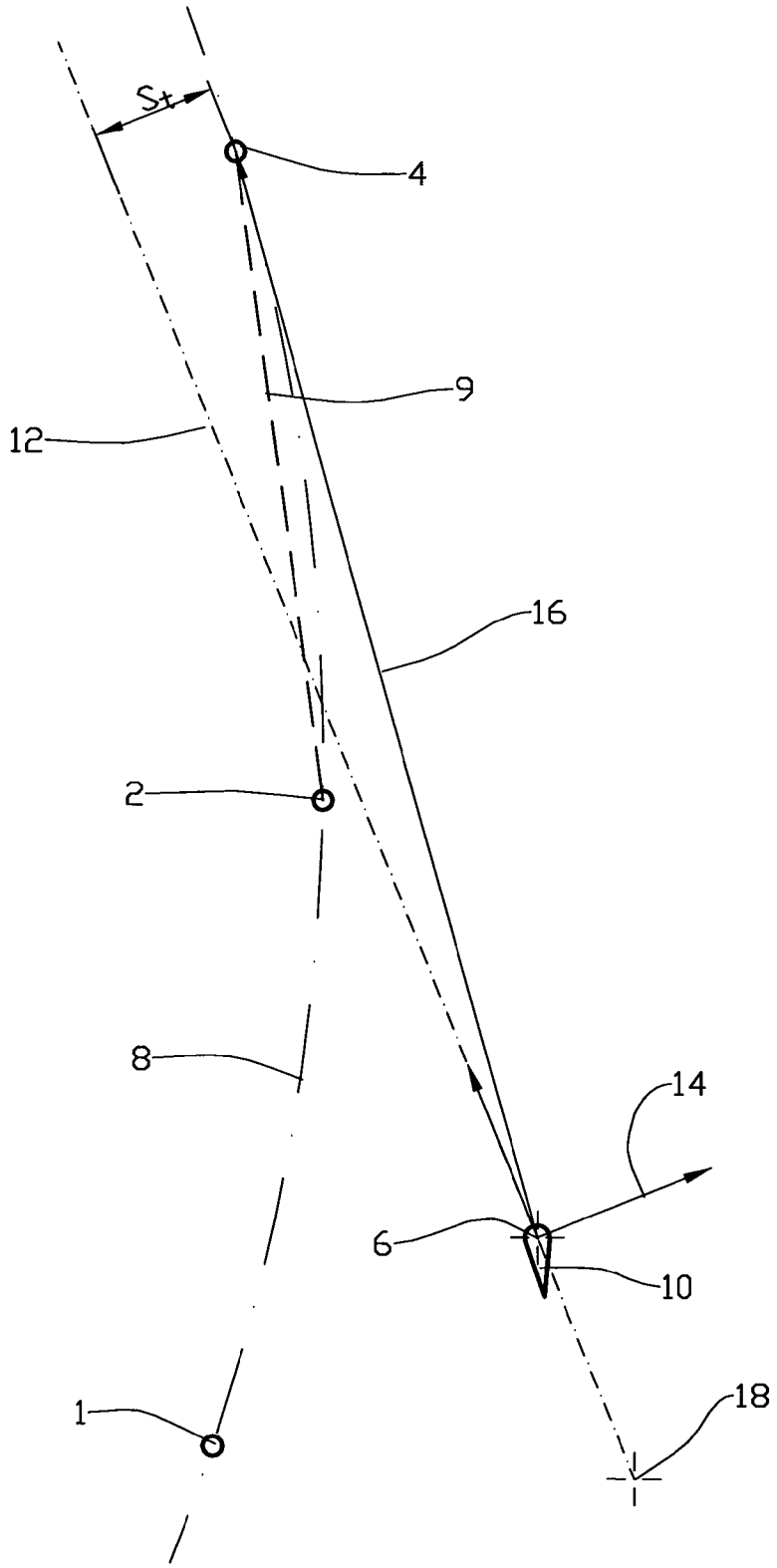
St
4
9
12
16
2
8
14
6
10
1
18

METHOD FOR DETERMINING CORRECTION UNDER STEERING OF A POINT ON A TOWED OBJECT TOWARDS A GOAL POSITION

CROSS-REFERENCE TO RELATED APPLICATIONS

This application is the United States National Phase of PCT Patent Application No. NO2010/000364 filed 15 Oct. 2010, which claims priority to Norwegian Application No. 20093176 filed 20 Oct. 2009, which are incorporated herein by reference.

BACKGROUND OF THE INVENTION

This invention relates to a method for determining correction during steering of a point on a towed object toward a target position. More particularly it concerns a method for determining correction during steering of a point on an on a towing device towed object, the object point, toward a target position, the object being provided with a rudder.

In the following a desired towing direction, such as between two target positions following each other, is called direction of motion, while the actual direction of motion of an object point is called inline, an in the horizontal plane relative to the inline lateral direction is called lateral direction, while a direction perpendicular to the horizontal plane is called vertical direction.

During towing of an object in a fluid such as water, it may be necessary to see provide for an object point to be in a certain position at a certain point in schedule. This is achieved according to prior art by controlling speed and direction at the same time as compensation is made for drift that may be caused by current, wind or other conditions.

If many points on a flexible object are to be controlled, as is necessary when towing such as long, seismic cables, it may be necessary to control these points individually in the lateral and vertical directions.

It is known to provide seismic cables with birds (well known technical term for rudder in the art) distributed along the length of the cables, and where each bird may be controlled from such as a towing vessel. A cable may be provided with one set of birds for vertical control and one set of birds for lateral control, but this is no requirement.

Thus UK document 2364388 describes a method for repetition of seismic measurements wherein both seismic source and receivers are controlled. The method comprises calculating where a predetermined point along the seismic cable shall be positioned for future firing of the source. However, the document does not describe how this shall be achieved.

NO document 20063819 deals with systems and a method for positioning of a centre of a marine seismic source or the like. The towing vessel is automatically controlled to hold the centre in a desired path. 3D coordinate and conventional PID control system is used for control of the vessel. The desired positions that each object point in succession shall be positioned in, may be constituted by points on a curve that the cable is to follow, or by other predetermined positions.

Experience has shown that prior art does not provide correction of the birds with the desired accuracy.

The object of the invention is to remedy or reduce at least one of the disadvantages of the prior art or at least provide a useful alternative to the prior art.

The object is achieved in accordance with the invention by the features disclosed in the below description and in the subsequent claims.

There is provided a method to determine correction during steering of at least a point on an object towed by a towing device, the object point, toward a target position, the object being provided with a bird, and wherein the method comprises:

- determining at least a target position;
- determining at least the position of an object point;
- determining at least the speed and acceleration of an object point and also their directions thereby determining at least an inline direction;
- determining if the inline is directed toward the target position, and, if it deviates from the desired direction,
- determining a distance vector between the object point and the target position;
- determining the distance, speed and acceleration components of an object point at least in the lateral direction or vertical direction; and
- transferring the values of said components to a control system for one or more corresponding birds.

The desired towing route for an object point is decided as a series of successive discrete points. Each of these points as a waypoint or relative point in relation to for example a towing vessel. The target position for steering of the object point is typically chosen at a distance adequate for there being time enough to perform steering before the target position is passed, for example 30 seconds.

The position of a corresponding object point is determined in a per se known manner at a point in time by means of GPS combined with compass and triangular and/or trilateral acoustic measurements.

A position vector may represent the difference in position between the object point position and the target position.

The direction of the relevant inline of the object point is determined for example by comparing earlier positions for the object point or by means of accelerometer and directional measurements in the object point.

If the relevant inline is directed toward the target position, then no correction is made. If the inline is not directed toward the target position, then the relevant position vector, the current speed and accelerations of components in lateral and vertical directions respectively are decomposed, whereafter the values of these components are transferred to a control system for the corresponding bird.

The method may further comprise:

- estimating the distance from the object point to the target position at a later point in time, at least in the lateral direction or the vertical direction, based on the calculated distance, speed and acceleration components; and
- transferring the value for the distance to a control system for a corresponding bird.

Estimated positions at several later points in time on the way forward toward the target position may profitably be transferred to the control system to give the control system an improved correction basis for its calculations.

The method may further comprise:

- determining the time taken before the object is at the target position in the inline direction;
- determining the necessary acceleration at least in the lateral direction or the vertical direction to correct the direction of the inline;
- transferring at least one acceleration value to a control system for the corresponding bird; and
- checking after a certain time whether the correction is adequate.

Speed and acceleration in the inline direction are controlled by the towing device and are not influenced by the bird or birds.

The time taken before the object point passes the target position is equal to the distance in the direction of movement between the object point and the target position divided by the speed of the towing device in the direction of movement.

At the same time it is desirable that the orientation of the object point is changed to pass through the desired position, being obtained by supplying the object point with the necessary accelerating forces in the lateral direction and in the vertical direction.

The distance the object point has to be displaced in the lateral direction is decided by the position vector component in the lateral direction, $S_t$.

$$s_t = v_t t + \frac{a_t}{2} t^2$$

wherein t is the time available before the waypoint is passed, $v_t$ is current speed in the lateral direction and $a_t$ is current acceleration in the lateral direction.

The necessary total acceleration that must be present in the object point in the lateral direction to balance the distance $s_t$ in the time t is given by:

$$a = \frac{v_t t - s_t}{t^2} * 2$$

Information about the necessary acceleration is transferred to the control system for the relevant bird so that the control system calculates the necessary change in bird deflection based on known principles for control engineering and among other things design data for bird and mass in the equipment point.

After a certain time being considerably less than t, the operation is repeated to check that the correction is adequate.

The method may further comprise calculating, based on current position, speed, acceleration and masses, the force that must be applied to the object point to achieve the desired acceleration, and to transfer the value of said force to the control system for the corresponding bird.

In a corresponding way the object point may also be controlled in the vertical direction.

The method according to the invention also provides, by means of relatively simple means, an improvement in the control precision for towed objects. This is particularly favourable in seismic measuring wherein multiple parallel long cables is often used involving a danger of entanglement.

In the following is described an example of a preferred method illustrated in the accompanying drawing, wherein:

FIG. 1 shows a sketch of relevant directions relative to waypoint and object point.

In the drawing the reference numerals 1, 2 and 4 indicate several discrete target positions for an object point 6 where the target positions 1, 2 and 4 are on a predetermined curve 8. The current direction of movement 9 is made up of a straight line between the target positions 2 and 4.

FIG. 1 is simplified in that it does not show components in the vertical direction, but corresponding relations like the ones explained below are also valid in the vertical direction.

The object point 6 is towed by a not shown towing device and is positioned close to a bird 10. The object point 6 has an inline 12. A line in the plane in perpendicular direction relative to the inline 12 is called lateral direction 14. A distance vector 16 shows the current distance between the object point 6 and the target position 4 constituting the current target position.

The distance $s_t$ between the inline 12 and the target position 4 gives the component of the distance vector 16 in the lateral direction 14.

The direction of the inline 12 is determined in a per se known manner based on earlier position measurements whereof one is carried out in position 18.

The distance $s_t$ and also a not shown distance in the vertical direction is transferred to a not shown control system for the bird 10 which adjusts the bird 10 to achieve the desired change of direction of the inline 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A method for determining direction to a target position during steering of a point on an object towed by a towing device, the object being provided with a bird (10), said method employs feedback-free control in determining the direction and comprises the following steps:

determining a first target position from a set of target positions (1, 2, 4);

determining by means of GPS combined with compass and triangular, trilateral, or triangular and trilateral acoustic measurements a position of a first object point (6);

determining velocity and acceleration of the object point (6);

determining a distance vector (16) between the first object point (6) and the first target position (1, 2, 4);

calculating the time taken before the first object point (6) is at the first target position (1, 2, 4);

calculating a necessary acceleration of the first object point (6) in at least the lateral direction (14) or the vertical direction for the first object point (6) to hit the first target position (1, 2, 4) at the calculated point in time;

transferring the necessary acceleration value to a steering system for the corresponding bird (10);

at a later point in time and before the first target position (1, 2, 4) is passed by the first object point (6), determining a second target position from a set of target positions (1', 2', 4') located beyond the first target position (1, 2, 4);

determining a position of a second object point (6');

determining velocity and acceleration of the second object point (6');

determining a distance vector (16') between the position of the second object point (6') and the second target position (1', 2', 4');

calculating the time taken before the second object point (6') is at the second target position (1', 2', 4');

calculating a necessary acceleration of the second object point (6') in at least the lateral direction (14') or the vertical direction for the second object point (6') to hit the second target position (1', 2', 4') at the calculated point in time; and transferring the necessary acceleration value to the steering system for the corresponding bird (10);

wherein the steering system directs each object point (6, 6') toward its respective target position (1, 2, 4; 1', 2', 4') independent of the other object point (6', 6) and its respective current position and target position (1', 2', 4'; 1, 2, 4) and each object point (6, 6') is continually being directed toward a respective next target position.

2. The method according to claim 1 wherein a desired towing route for the first and second object points (6, 6') and all successive object points (6") is a series of successive discrete points, each successive discrete point being a target position in the set of target positions (1, 2, 4; 1', 2', 4'; 1", 2", 4").

* * * * *